United States Patent [19]

Fienberg

[11] Patent Number: 5,046,737

[45] Date of Patent: Sep. 10, 1991

[54] LOTTERY-TYPE GAME SYSTEM WITH BONUS AWARD

[75] Inventor: Debra Fienberg, Chicago, Ill.

[73] Assignee: Douglas Press, Inc., Bellwood, Ill.

[21] Appl. No.: 617,361

[22] Filed: Nov. 23, 1990

[51] Int. Cl.[5] ..... A63F 3/06; B42D 15/00

[52] U.S. Cl. ..... 273/139; 283/903; 283/901

[58] Field of Search ..... 273/139, 138 R; 283/903, 901, 105, 103, 102, 101, 100, 98

[56] References Cited

U.S. PATENT DOCUMENTS

| | | | |
|---|---|---|---|
| 3,900,219 | 8/1975 | D'Amato | 273/139 |
| 4,033,611 | 7/1977 | Johnsen | 283/903 |
| 4,740,016 | 4/1988 | Konecny et al. | 283/903 |
| 4,943,090 | 7/1990 | Fienberg | 273/139 |

FOREIGN PATENT DOCUMENTS

| | | | |
|---|---|---|---|
| 1302438 | 1/1973 | United Kingdom | 273/139 |

OTHER PUBLICATIONS

Product Brochure, "BANK 200/250", Break Open Games, 2 pages, 1989.

Product Brochure, "BANKER'S CLUB", Break Open Games, 2 pages, 1987.

Product Brochure, "DOUBLE ZERO'S", Break Open Game, 2 pages, 1987.

Product Brochure, "WINNERS CLUB TM", Game, 2 pages, 1987.

Product Brochure, "SEAL CARD GAMES", 4 pages, 1987.

*Primary Examiner*—Benjamin Layno

*Attorney, Agent, or Firm*—Dressler, Goldsmith, Shore, Sutker & Milnamow, Ltd.

[57] ABSTRACT

A lottery-type game system providing multiple levels of play includes a plurality of playing cards and a master game card used in conjunction therewith. Each of the playing cards includes a plurality of game symbols, with predetermined selected ones of the game symobls being used to identify players eligible for a bonus award. The master game card includes an arrangement for listing the selected players, and thereafter identifying one of the players, which player thereby becomes eligible for a bonus award by selecting one of a plurality of award values concealed on the master game card.

7 Claims, 2 Drawing Sheets

BONUS SECTION
OPEN 1 SEAL ONLY
BONUS AWARD
YOU WIN $5
Bonus Award Seal Value $
WIN $300
113
AND PICK ONE SEAL IN BONUS SECTION.
BONUS 300
ALL TICKETS ENDING IN 3 HOLD TICKETS FOR CHANCE ON BONUS AWARD AND...
$300
$50
$20
$15
$10
$5
$2
$1
ALL NUMBERS ENDING IN 66, 77, 88 & 99
013
113
213
313
413
513
613
713
813
913
1013
1113
1213
1313
1413
1513
1613
1713
LAST SALE
Plum
Cherry
Plum
10
12
14
16
18
20
20
24
26
28
30
32
34
36
36
38
38
38
40

LOTTERY-TYPE GAME SYSTEM WITH BONUS AWARD

TECHNICAL FIELD

The present invention relates generally to lottery-type game systems, and more particularly to a game system having multiple levels of play, including an arrangement for identifying a selected plurality of game players, and thereafter identifying at least one selected player eligible to play for a bonus award.

BACKGROUND OF THE INVENTION

Lottery-type games of chance have exhibited enduring popularity, since such games typically permit a player to make a relatively small "investment" with a chance of winning a significantly larger award. In addition to the entertainment value that such games provide for the players, these types of game systems typically provide a source of revenue for the operator, be it a municipality, a charity, or business establishment.

One type of game system which has proven quite popular with players are the so-called break-open jar games. In this type of game, players purchase playing cards for a relatively nominal sum, with each playing card displaying game symbols, selected ones of which correspond to award values. In a typical configuration, each playing card comprises a lamination of upper and lower plies of material, such as paper, with the game symbols displayed on the inside surface of the lower ply. The game symbols are thus initially sealed, and are revealed by "breaking open" one or more flap-like portions of the upper ply.

As will be appreciated, affording players an opportunity to win awards in different ways enhances the entertainment value of the game. The present game system contemplates an arrangement whereby selected players become eligible for a bonus award, with at least one of these players, in turn, having an opportunity to win the bonus.

SUMMARY OF THE INVENTION

The lottery-type game system embodying the principles of the present invention provides multiple levels of play, including an arrangement whereby selected players become eligible for a bonus award, with at least one of the selected players thereafter selecting a plurality of concealed awards in an effort to win the bonus. Thus, the overall system involves at least three levels of play for which all players are potentially eligible, with an alternate embodiment of the game system including an additional level of play to provide four levels.

In accordance with the illustrated embodiment, the present game system includes a plurality of playing cards each of which can be purchased by game players for a predetermined price per playing card. Each of the playing cards has a plurality of groups of game symbols displayed thereon, with each of the cards including selectively removable means for initially concealing the groups of game symbols prior to purchase by the player. The means for concealing the game symbols, comprising flap-like portions of the playing cards in the illustrated embodiment, are removed by the player after purchase of the playing card. In this first level of play, the player can then determine if any of the groups of symbols correspond to predetermined winning groups.

The game system further includes a master game card for use in conjunction with the playing cards. For a second level of play, at least one of the master game card and the playing cards have displayed thereon an arrangement for establishing the eligibility of a plurality of selected game players having playing cards displaying predetermined selected ones of the game symbols. In the illustrated embodiment, some of the playing cards include numeric game symbols, with certain ones of the numeric game symbols comprising the predetermined ones by which the selected game players are identified. Additionally, certain selected players, such as the player who purchases the last one of the playing cards of a given set, may be included in the group of selected, eligible players. In the illustrated embodiment, the master game card includes an arrangement for listing the eligible players.

For the second level of play, the master game card also includes an arrangement for identifying at least one of the eligible players. In the illustrated embodiment, this is provided by an arrangement which identifies at least one predetermined game symbols (which symbols correspond to the eligible players), with selectively removable means for concealing the predetermined one or ones of the game symbols prior to the listing of all of the eligible game players. Alternately, one or more of the eligible players can be identified by other than the game symbols, such as by specifying a certain selected player (such as the purchaser of the last game playing card).

In the illustrated form, the selected one of the eligible players receives a certain predetermined award attendant to that player's identification. Additionally, that one player becomes eligible for the third level of play of the system.

For purposes of a third level of play, the master game card further includes an arrangement for identifying a bonus award comprising a plurality of award values displayed on the master game card, and selectively removable means for concealing the award values. In this way, the selected one or ones of the eligible players can determine the award to be received by removing the concealing means associated with one of the award values. In the illustrated embodiment, one of the award values identifies a "bonus award", which has been previously prominently displayed on the master game card to enhance player interest.

In an alternate embodiment, the master game card provides a fourth level of play, and includes an arrangement for identifying another award, which comprises a second plurality of award values displayed on the master card, and selectively removable means for concealing the second plurality of award values. In this embodiment, a predetermined one of the first plurality of award values entitles the selected player to remove the concealing means associated with one of the second plurality of award values. In the illustrated embodiment, this second group of award values is identified in a "jackpot section", with one of the second award values comprising the "jackpot". The jackpot corresponds to an award previously identified prominently on the master playing card.

Other features and advantages of the present invention will become readily apparent from the following detailed description, the accompanying drawings, and the appended claims.

DETAILED DESCRIPTION

Figures 1, 2:
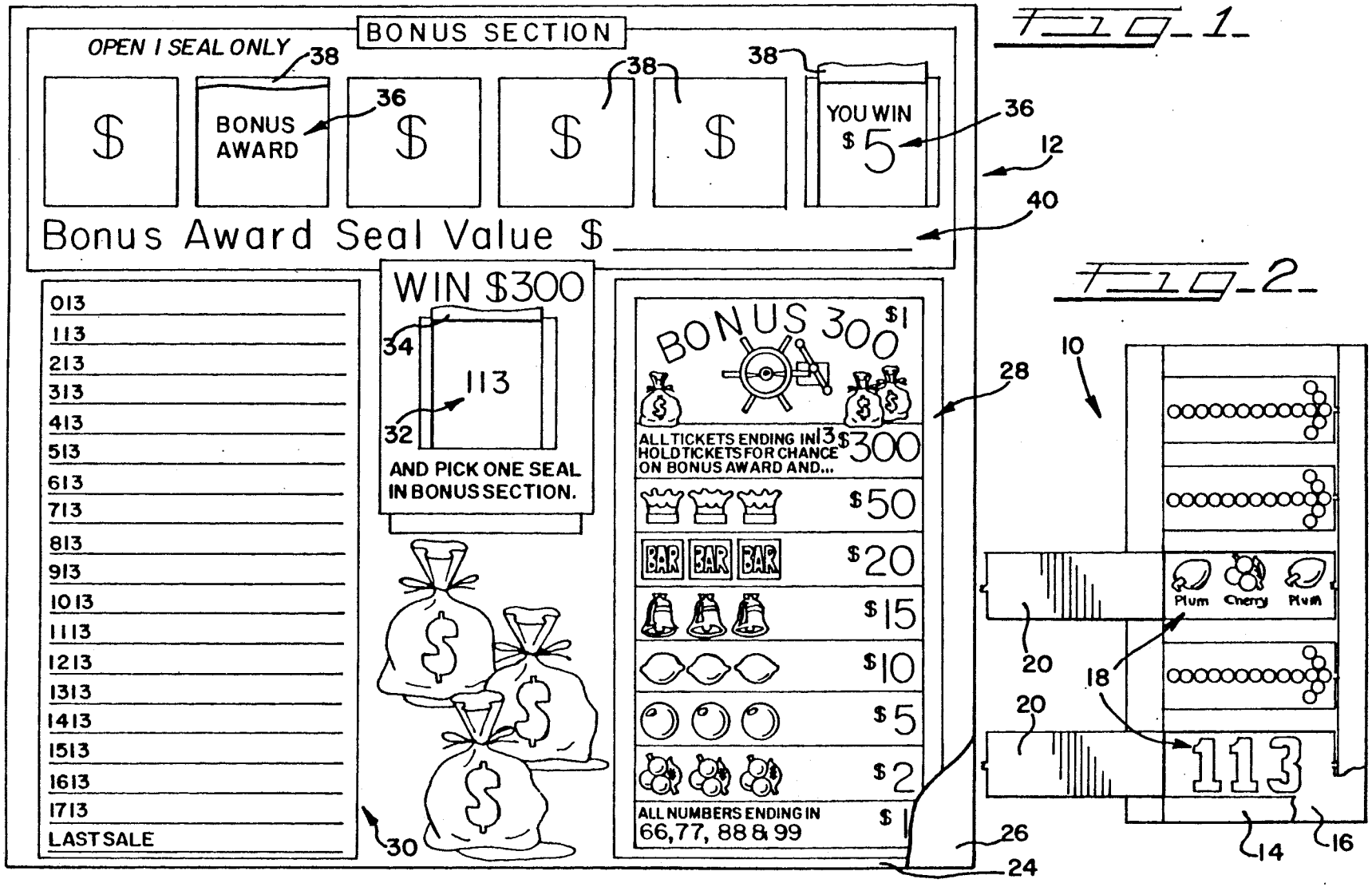
FIGS. 1 and 2 are plan views, partially cut-away, respectively illustrating a master game card and a playing card of the present game system.

While the present invention is susceptible of embodiment in various forms, there is shown in the drawings and will hereinafter be described first and second embodiments of the invention, with the understanding that the present disclosure is to be considered as an exemplification of the invention, and is not intended to limit the invention to the specific embodiments illustrated.

With reference now to FIGS. 1 and 2, therein are illustrated a playing card 10 and a master game card 12 embodying the present game system. Playing card 10 is intended as exemplary, in that the present game system includes a substantial plurality of such playing cards. Each of these playing cards is purchased by a game player, with certain ones of the players being eligible to participate in selection of a bonus award on the master game card 12.

Each of the playing cards 10 preferably comprises a lamination of upper and lower plies of material 14 and 16, such as comprising paper or the like. Each of the playing cards displays a plurality of groups of game symbols 18, which symbols are displayed on the inside surface of the lower ply 16 of the card. This type of card is typically referred to as a "break-open" playing card, in that flap-like portions 20 of the upper ply 14 can be selectively removed from each of the groups of game symbols 18 in order to reveal the game symbols after the card has been purchased. However, it will be understood that a game embodying the principles of the present invention may include playing cards and a master game card otherwise configured, such as including "scratch-off" arrangements for initially concealing game symbols.

In its first level of play, the present game system provides awards to those players having cards which display predetermined winning groups of award symbols. In its two additional levels of play, the present system permits selected ones of the players to become eligible for a bonus award, and thereafter at least one of the players plays for the bonus, through use of the master game card 12.

The master game card 12 preferably comprises a lamination of upper and lower plies of material 24 and 26. To assist players in ascertaining winning cards at the first level of play, a listing 28 of winning groups is preferably provided on the master game card.

The second level of play of the present game system entails establishing selected game players who become eligible for the bonus award, with these players then listed on the master game card 12 in the illustrated embodiment. To this end, the master game card 12 includes an arrangement 30 for listing the selected, eligible players. In the illustrated embodiment, the eligibility of these selected players is established by those players having cards having predetermined selected ones of the game symbols. In the illustrated embodiment, such predetermined game symbols comprise numeric designations (i.e., 013, 113, 213, etc.). In addition, the illustrated game permits the player who purchases the last playing card of the set to be eligible for the bonus award by entry in the "last sale" listing.

The master game card further includes an arrangement whereby at least one of the listed, eligible players is identified, with that player then being eligible to play for the bonus award. This is provided by at least one bonus player identifier 32 on the inside surface of the lower ply 26 of the master game card, with this identifier concealed by a selectively removable flap-like portion 34 (shown partially cut-away) of the upper ply 24 of the master game card. As will be noted, the identifier 32 corresponds to a predetermined one of the selected game symbols, such as the numeric symbol 113, or to the "last sale" designation.

As will be appreciated, the bonus player identifier 32 is not revealed until all of the eligible selected players have been established, and entered at listing 30, if provided. When the identifier 32 is revealed, that one player then becomes eligible for the bonus award, which award is determined by the "bonus section" of the master game card. In addition, the 10 player identified may automatically win a predetermined award (i.e., $300.00 in the illustrated embodiment). While the illustrated embodiment includes a single identifier 32, a plurality of such identifiers can alternately be provided, whereby a like plurality of the eligible players become further eligible to play the "bonus section".

The bonus section of the master game card 12 provides the third level of play of the present system, and identifies a plurality of awards 36 on the inside surface of lower ply 26, each of which is concealed by a respective flap-like portion 38 of the upper ply 24. It is contemplated that the bonus player will open only one of the flap-like portions 38, with only one (or optionally more than one) of the awards 36 corresponding to the "bonus award", while the other awards will be relatively nominal in nature. The value of the "bonus award" is preferably prominently displayed at 40 on the master game card so that all game players are aware of the potential bonus they might win.

Figure 3:
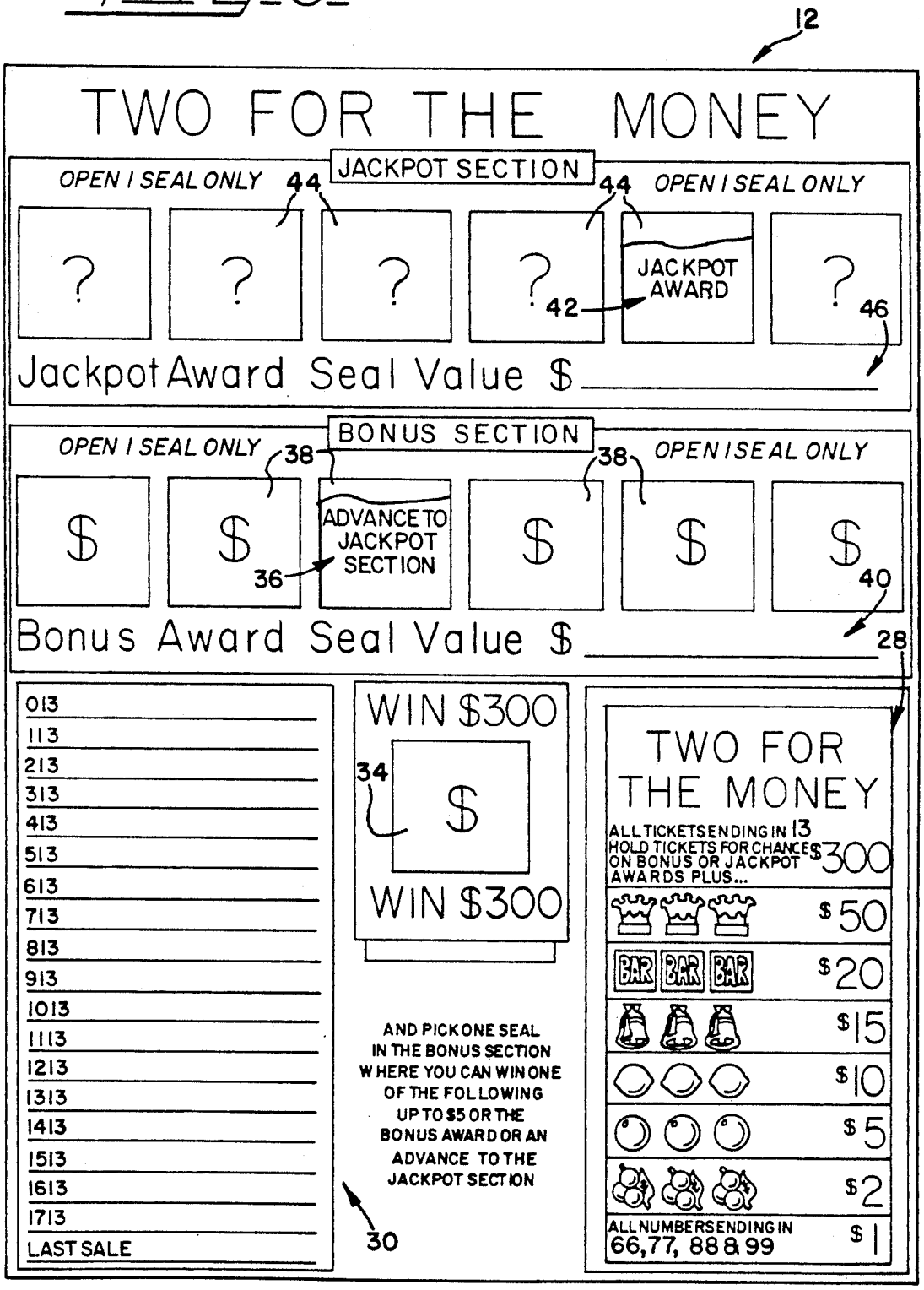
FIG. 3 is a plan view, partially cut-away, of an alternate embodiment of a master game card of the present game system.

Referring to FIG. 3, an alternate embodiment of the master game card 12 is illustrated. In this embodiment, an additional fourth level of play is provided by a "jackpot section", eligibility for play of which is determined at the "bonus section".

Specifically, the "jackpot section" includes a plurality of jackpot section awards 42 displayed on the inside surface of the lower ply of the card, with a plurality of flap-like portions 44 respectively concealing the award values 42. In this embodiment, at least one of the bonus section awards 36 specifies "advance to jackpot section", thus entitling the selected player to open one of the flap-like portions 44 in the "jackpot section". In turn, at least one of the jackpot section awards 42 specifies "jackpot award", which award is preferably prominently displayed at 46 on the game card.

As will be appreciated, variations of the present system can be made within the purview of the present invention. As noted, the playing cards 10 can be otherwise configured, as can the master game card 12. If desired, more than the disclosed three or four levels of play can be provided. Additionally, plural arrangements can be provided for establishing the eligibility for bonus play of selected players. For example, two listings of eligible players can be provided on the master game card, with two different criteria identified for establishing eligibility.

From the foregoing, it will be observed that numerous modifications and variations can be effected without departing from the true spirit and scope of the novel concept of the present invention. It is to be understood that no limitation with respect to the specific embodiments disclosed herein is intended or should be inferred. The disclosure is intended to cover by the appended claims all such modifications as fall within the scope of the claims.

What is claimed is:

1. A lottery-type game system providing multiple levels of play, comprising:

a plurality of playing cards each of which can be purchased by game players for a predetermined price per playing card, each of said playing cards having a plurality of groups of game symbols displayed thereon, with each of said cards including selectively removable means for concealing the groups of game symbols thereon prior to purchase by a player, said means for concealing said game symbols being removed by the player after purchase for providing a first level of play, and a master game card for use in conjunction with said playing cards, at least one of said master game card and said plurality of playing cards having displayed thereon means for establishing the eligibility of a plurality of selected game players having playing cards displaying predetermined selected ones of said game symbols, said master game card including means for identifying at least one of said eligible players, and selectively removable means for concealing said identifying means prior to establishing all of said eligible game players for providing a second level of play, said master game card further including award identifying means comprising a plurality of award values displayed on said master game card, and selectively removable means for concealing said award values, so that said selected one of said eligible players can determine the award to be received by removing the concealing means associated with one of said award values for providing a third level of play.

2. A lottery-type game system in accordance with claim 1, wherein said master game includes another award identifying means comprising a second plurality of award values displayed on said master card, and selectively removable means for concealing said second plurality of award values, at least one predetermined one of first-said plurality of award values entitling the selected player to remove the concealing means associated with one of said second plurality of award values for providing a fourth level of play.

3. A lottery-type game system in accordance with claim 1, wherein said master game card includes means identifying winning groups of said game symbols and corresponding award values.

4. A lottery-type game system in accordance with claim 1, wherein said award values comprise dollar values.

5. A lottery-type game system in accordance with claim 1, wherein said selected ones of said game symbols comprises numeric designations.

6. A lottery-type game system in accordance with claim 1, wherein each of said playing cards and said master game card comprises a lamination of upper and lower plies of material, with each said concealing means comprising a flap-like portion of the upper ply of material of the respective card.

7. A lottery-type game system in accordance with claim 1, wherein said master game card has displayed thereon means for listing said plurality of eligible game players.

* * * * *